US010731817B2

(12) United States Patent
Pellarin et al.

(10) Patent No.: US 10,731,817 B2
(45) Date of Patent: Aug. 4, 2020

(54) LUMINOUS MODULE COMPRISING A MATRIX ARRAY OF LIGHT SOURCES AND A BIFOCAL OPTICAL SYSTEM

(71) Applicant: Valeo Vision, Bobigny (FR)

(72) Inventors: Marie Pellarin, Bobigny (FR); Vanesa Sanchez, Bobigny (FR); Sebastien Roels, Bobigny (FR); Jerome Le Corre, Bobigny (FR); Marine Courcier, Unterfoehring (DE)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 16/527,862

(22) Filed: Jul. 31, 2019

(65) Prior Publication Data

US 2020/0041093 A1 Feb. 6, 2020

(30) Foreign Application Priority Data

Jul. 31, 2018 (FR) ..... 18 57186

(51) Int. Cl.

| | |
|---|---|
| ***F21S 41/26*** | (2018.01) |
| ***F21S 41/24*** | (2018.01) |
| ***F21S 41/153*** | (2018.01) |
| ***F21S 41/20*** | (2018.01) |

(Continued)

(52) U.S. Cl.

CPC ..... *F21S 41/26* (2018.01); *F21S 41/153* (2018.01); *F21S 41/24* (2018.01); *F21S 41/255* (2018.01); *F21S 41/285* (2018.01); *F21S 41/141* (2018.01)

(58) Field of Classification Search

CPC .. F21S 41/26; F21S 41/24; F21S 41/25; F21S 41/151; F21S 41/153; F21S 41/285

See application file for complete search history.

(56) References Cited

U.S. PATENT DOCUMENTS

| | | | | |
|---|---|---|---|---|
| 2007/0183164 | A1 | 8/2007 | Naganawa et al. | |
| 2009/0147529 | A1 * | 6/2009 | Ajiki ..... | G02B 6/0038 362/511 |
| 2014/0307459 | A1 | 10/2014 | Brendle et al. | |

(Continued)

FOREIGN PATENT DOCUMENTS

| | | |
|---|---|---|
| DE | 102008013603 | 9/2009 |
| EP | 1 965 126 A1 | 9/2008 |

(Continued)

OTHER PUBLICATIONS

French Preliminary Search Report dated Jun. 11, 2019 in French Application 18 57186 filed Jul. 31, 2018 (with English Translation of Categories of Cited Documents).

*Primary Examiner* — William N Harris

(74) *Attorney, Agent, or Firm* — Oblon, McClelland, Maier & Neustadt, L.L.P.

(57) ABSTRACT

A luminous motor-vehicle module, comprising an array of light sources and a bifocal imaging device that is designed to project an image of each light source, wherein the luminous module comprises at least one primary optical element, which at its exit does not modify in a vertical direction V the angle of the incident rays, and which allows secondary sources to be formed the lateral dimension of which is larger than a lateral dimension of the light sources and the angular aperture of the emitted secondary light beams of which is smaller than an angular aperture of the light beams emitted by the light sources.

20 Claims, 6 Drawing Sheets

(51) Int. Cl.
*F21S 41/255* (2018.01)
*F21S 41/141* (2018.01)

(56) References Cited

U.S. PATENT DOCUMENTS

| | | | | |
|---|---|---|---|---|
| 2015/0131305 | A1 | 5/2015 | Courcier et al. | |
| 2015/0241009 | A1* | 8/2015 | Brendle | F21S 41/143 362/521 |
| 2016/0312970 | A1* | 10/2016 | Suwa | B60Q 1/0076 |
| 2017/0241605 | A1* | 8/2017 | Yamamoto | F21S 41/148 |
| 2017/0241607 | A1* | 8/2017 | Courcier | F21S 41/255 |
| 2018/0149336 | A1* | 5/2018 | Tsai | F21S 41/151 |
| 2018/0245760 | A1* | 8/2018 | Kanayama | F21S 41/24 |
| 2018/0245761 | A1* | 8/2018 | Tsuji | F21S 41/143 |
| 2018/0266642 | A1* | 9/2018 | Ohno | F21S 41/24 |

FOREIGN PATENT DOCUMENTS

| | | | |
|---|---|---|---|
| EP | 2 532 950 | A1 | 12/2012 |
| EP | 2 789 900 | A2 | 10/2014 |
| EP | 2 840 298 | A1 | 2/2015 |

* cited by examiner

LUMINOUS MODULE COMPRISING A MATRIX ARRAY OF LIGHT SOURCES AND A BIFOCAL OPTICAL SYSTEM

TECHNICAL FIELD OF THE INVENTION

The invention relates to a luminous module for a motor vehicle that is able to project a light beam containing horizontally adjoining segments and having an angular resolution in vertical planes higher than 1°.

TECHNICAL BACKGROUND OF THE INVENTION

A motor vehicle is equipped with headlamps intended to produce a light beam that illuminates the road in front of the vehicle, in particular at night or in the case of low light levels.

Luminous modules of this type are already known. Such luminous modules are able to produce an illuminating light beam, for example a high beam, divided, vertically and horizontally, into luminous segments and at least certain luminous segments of which may be selectively turned off. This for example allows the road to be illuminated optimally while avoiding subjecting road users to glare.

Such luminous modules generate segmented light beams, which are known as pixel beams. It is for example possible to divide the overall light beam into a matrix array of luminous segments.

Generally, the vertical resolution of the light beam, i.e. the number of light segments in the vertical planes of the beam emitted by a headlamp, remains quite low. Thus, turning off one luminous segment plunges into darkness a segment of road that is often much larger than required to prevent a road user from being subjected to glare. It would be advantageous to be able to increase the vertical resolution of the light beam in order to be able to illuminate the road up to a road user located in front of the vehicle, while turning off luminous segments liable to subject the road user to glare.

These headlamps are preferably designed to illuminate a large lateral visual field but known lighting systems have a visibility that vehicle drivers sometimes find unsatisfactory. In particular, it is difficult, or even impossible, to ensure a large field of illumination in the horizontal plane of the path of the vehicle and to simultaneously ensure a high resolution in the vertical direction, for any angle in the horizontal plane. In addition, it is important to decrease the size of the projecting lenses, which should preferably have a diameter smaller than 80 mm, while using commercially available arrays of light-emitting diodes that each have a minimum size of 0.75 mm×0.75 mm. Moreover, for reasons of visual comfort, and for regulatory reasons, it is preferable for two adjacent segments in the horizontal plane to adjoin so that the overall light beam illuminates the road uniformly. However, known solutions do not allow a high vertical resolution to be obtained at the same time as a large horizontal field containing adjoining luminous segments, in particular when the light sources are too far apart from one another.

A known motor-vehicle headlamp lighting system, described in document US 2014/0307459 A1, comprises a primary optical module comprising a plurality of light sources, for example light-emitting diodes, each associated with respective light guides. A projecting secondary optical element, for example a lens, is associated with the primary optical module. This projecting secondary optical element may have a plurality of focal lengths. Such a lighting system nevertheless has certain drawbacks. Firstly, such a primary optical module, comprising a plurality of independent light guides each associated with one light source, is complex and expensive to produce. Thus, the focal lengths are chosen to coincide with the exit surfaces of the primary optic. Thus, this system requires the primary optic to be positioned at an angle relative to the optical axis of the projecting element, this making aligning and assembling the optical system complex and therefore expensive. The major drawback of such a system is that it is not possible to achieve vertical resolutions higher than 0.6° if standard commercially available light sources and projecting lenses having a large diameter, typically larger than 100 mm, are used.

Another lighting system, described in document DE102008013603, relates to an optical module comprising a matrix array of light emitters and allows a uniform light beam to be projected. The system comprises a matrix array of optical elements, each of funnel shape. Each optical element of the matrix array is positioned facing an emitter and its reflective interior surface ensures that a substantially parallel beam is projected towards the projector. Such a matrix array of conical reflective elements is expensive to manufacture. Furthermore, as with the projecting module described in document US 2014/0307459 A1, the system described in document DE102008013603 does not allow a high vertical resolution associated with a large horizontal projection angle to be obtained.

In another embodiment, described in document US2015131305A a strip of light sources is adapted to an integrally formed optical structure comprising a single light guide connected to a correcting optical portion. The bifocal secondary optic, ensuring the projection of light into the far optical field, has a vertical focal plane that coincides with the exit surface of the optical guide, this of course resulting in a poor resolution in the vertical direction.

SUMMARY OF THE INVENTION

The invention provides a luminous motor-vehicle module, defining a direction of movement (L), a vertical direction (V) and a horizontal direction (H) orthogonal to the vertical direction (V), the directions (L) and (V) defining a vertical plane and the directions (L) and (H) defining a horizontal plane, comprising:

- at least one array of light sources, comprising m transverse rows and n vertical rows the transverse rows being arranged in a direction perpendicular to the vertical rows, the number n being higher than the number m;
- at least one bifocal imaging device designed to project a light beam, the imaging device having a horizontal first focusing surface and a vertical second focusing surface parallel to said first surface;

characterized in that the luminous module comprises at least one primary optical element, which at its exit does not modify in a vertical direction V the angle of the incident rays, said primary optical element being arranged to transfer the light emitted by said light sources to a virtual projecting surface that is defined between said array and the imaging device, and that is coincident with the first focusing surface, in such a way that the projections in the horizontal plane of the beams emitted by said light sources form, on said virtual projecting surface, secondary light sources that are stretched in the horizontal direction, and in that the vertical second focusing surface is coincident with the surface of the array of the light sources. In the horizontal plane, a dimension of the secondary light sources is larger than a dimension of the light sources and an angular aperture of the secondary light beams emitted by the secondary light sources is smaller than an angular aperture of the light beams emitted by said light sources.

A luminous module produced according to the teachings of the invention thus allows a light beam having a large horizontal field of illumination and a high angular resolution in any plane parallel to the vertical direction to be formed. Such a primary optical element is very easy to manufacture and robust and easy to assemble in a luminous module, and therefore inexpensive to manufacture.

According to a first embodiment of the invention, the primary optical element is an array of cylindrical lenses. The longitudinal axis of each cylindrical lens is parallel to one of the vertical rows of light sources. Such an array of cylindrical lenses is easy and inexpensive to manufacture, for example via a plastic injection moulding method.

In one preferable embodiment, the cylindrical lenses are designed to form, on the virtual projecting surface, secondary light sources the horizontal component of which is an enlargement by a factor M of the horizontal component of the light sources.

Advantageously, the enlargement factor M is at least equal to 2.

Preferably, the cylindrical lenses are designed such that said secondary light sources adjoin. This avoids obtaining projections of dark strips in the vertical direction.

As a variant, the cylindrical lenses are designed so that said secondary light sources partially overlap in the horizontal direction. This allows a uniform field of illumination to be obtained.

In another variant, the overlap of the secondary light sources in the horizontal direction is smaller than 20% of the width of their horizontal component.

In a second embodiment of the invention, the primary optical element comprises an array of light guides, said array being placed between said array of light sources and the imaging device. The use of light guides allows the light emitted by the secondary sources to be made more uniform.

Advantageously, the array of light guides is made up of light guides having a first surface on the side of said array and a second surface, also defined as the exit surface, opposite to the first surface having, in any plane parallel to the horizontal direction, a width larger than the width of the first surface. This makes it possible to decrease, in any plane parallel to the horizontal direction, the angle of emission of the beams directed toward the projecting optic.

As a variant, the light guides have a trapezoidal shape in cross section parallel to the horizontal direction and a rectangular shape in any cross section defined in a vertical plane parallel to said array. The manufacture of light guides having a cross section of trapezium shape is easy and inexpensive and it is possible to obtain surfaces of very high optical quality.

In one variant, the light guides have in any horizontal plane a shape comprising curved lateral edges, i.e. their lateral faces are curved. The use of guides the sidewalls of which are curved, and preferably concave, allows the optical qualities of the beams emitted by the secondary sources to be improved. Curved faces such as defined by polynomials may increase the number of ways in which the luminous module is optimizable.

Advantageously, said first surface is in immediate proximity to the light exit surface of a light source of said vertical row. The immediate proximity has the advantage of guaranteeing that the transmission to the virtual projection plane of the light emitted by the light sources is highly effective. Advantageously, this virtual projection plane is coplanar with the exit surface of the light guides.

In preferred variants, the width of the second surface has, in any cross section parallel to the horizontal plane, a dimension equal to or larger than twice the width of the first surface.

In one variant embodiment, the primary optical element comprises diffractive optical elements. Using diffractive elements allows the intensity distributions emitted by the light sources to be corrected and therefore the optical quality of the beam to be increased. It is easy to integrate diffractive structures or refractive structures into moulded parts or parts produced by plastic injection moulding, without increasing the cost thereof.

In variant embodiments, n is at least equal to 10 and m is at least equal to 20. The use of arrays comprising a high number of light sources allows the angular resolution of the optical beam emitted by the imaging device to be considerably increased.

Advantageously, the angular aperture of a light beam emitted by the luminous module originating from a single light source is higher than 1° along the vertical axis.

In one variant embodiment, the angular aperture of a light beam emitted by the luminous module originating from a single light source is higher than 0.6° along the vertical axis. This allows a high vertical angular resolution to be obtained.

Advantageously, the vertical angular aperture of the light beam emitted by the module, originating from all the light sources of the array, is at least equal to 2°, and preferably at least equal to 4° and at most 9°.

In one variant embodiment, the horizontal angular aperture of the light beam emitted by the module, originating from all of the light sources of the array, is larger than 10° and preferably larger than 20°. This allows a very large field of horizontal illumination to be obtained while ensuring a high vertical resolution.

BRIEF DESCRIPTION OF THE FIGURES

Other features and advantages of the invention will become apparent on reading the following detailed description for the comprehension of which reference is made to the appended drawings, in which.

DETAILED DESCRIPTION OF THE FIGURES

In the rest of the description, nonlimitingly, the longitudinal orientation is directed from back to front, the vertical orientation is directed from bottom to top, and the transverse orientation is directed from left to right, as indicated by the system of axes "L, V, T" in the figures.

The vertical orientation "V" is used as a geometric reference of the luminous module 10 and has no relation to the direction of gravity.

The directions L and V define a vertical plane 32 and the directions L and H define a horizontal plane 34.

In the rest of the description, elements having an identical structure or analogous functions will be referenced with the same references.

Figure 1:
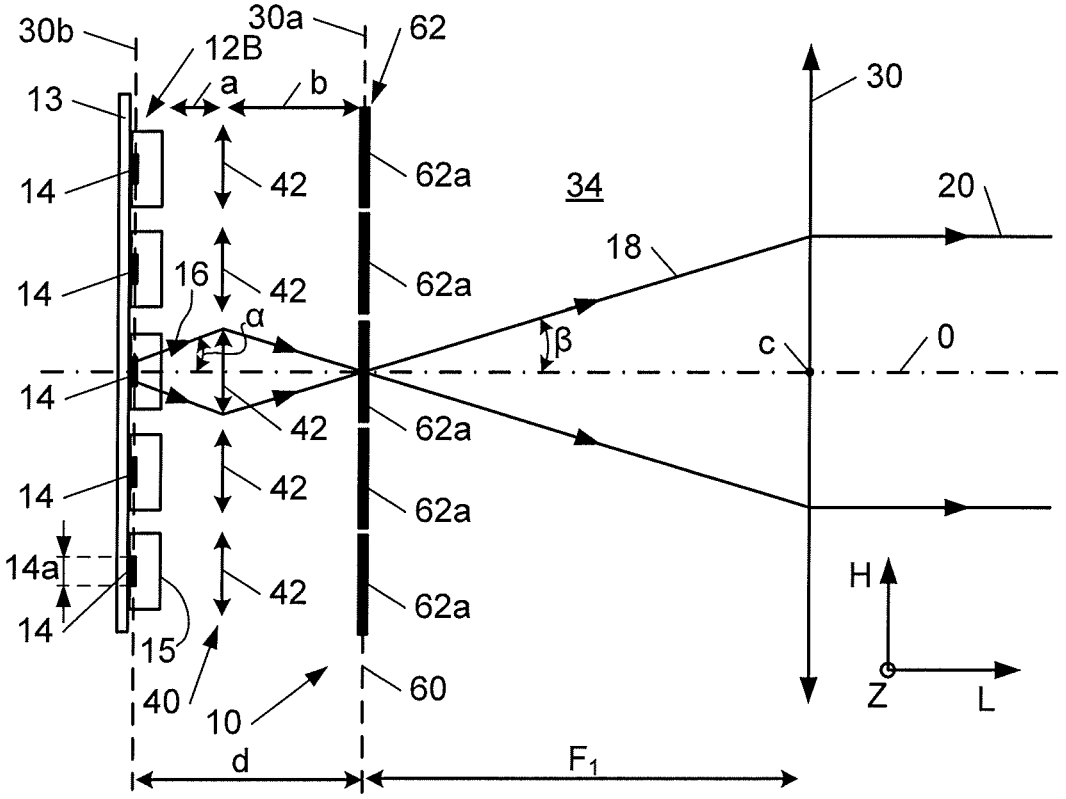
FIG. 1 is a top view that shows a primary optical element and a secondary optical element of a luminous module produced according to the concept of the invention.
Figure 2:
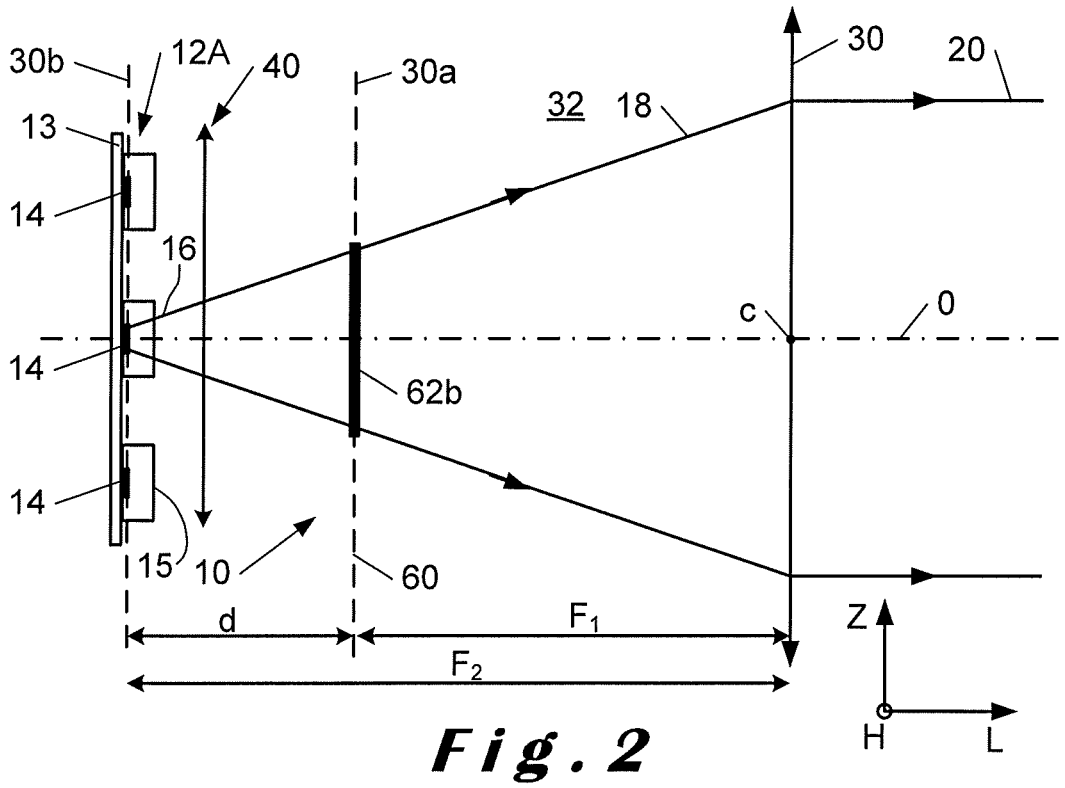
FIG. 2 is a side view that shows a primary optical element and a secondary optical element of a luminous module produced according to the concept of the invention.

FIG. 1 and FIG. 2 show a horizontal cross section (FIG. 1) and a vertical cross section (FIG. 2) of a luminous module with which a motor-vehicle lighting or signalling device is intended to be equipped. The luminous module 10 is intended to emit a final light beam longitudinally toward in front of the vehicle. It is here a question of a light beam that is composed of a plurality of adjoining elementary beams. Such a luminous module 10 is in particular able to perform a lighting function having a large transverse angular aperture and a high vertical angular resolution. Each elementary light beam illuminates a segment (referred to as a "luminous segment" below), such a segment also being known as a "pixel". In the description, the expression "vertical resolution" is understood to mean the angular size of each segment.

The luminous module 10 defines an optical axis O, parallel to the longitudinal orientation L, and comprises at least one array 12 of light sources 14, comprising m transverse rows 12A and n vertical rows 12B of light sources 14 that are in particular shown in FIGS. 1, 2, 3, 4, and 5. The transverse rows 12A are arranged in a direction perpendicular to the vertical rows 12B and the number n of vertical rows 12B is higher than the number m of transverse rows 12A.

It will be noted that, in FIGS. 1 and 2, the proportions of the horizontal and vertical spacings between the light sources 14 are not accurate; specifically, the vertical spacing between the sources is in fact smaller than the horizontal spacing.

Each light source 14 is formed by a light-emitting source that is preferably, but not necessarily, a light-emitting diode that has a square or rectangular emission surface that lies in a plane substantially orthogonal to the optical axis O.

The array 12 of light sources 14 is borne by a carrier, preferably a printed circuit board 13. The light sources 14 may be turned on independently of one another, selectively, in order to obtain the desired illumination.

In one variant, the array 12 may consist of an assembly of a plurality of vertical strips 12B of light sources 14, and each of the strips may be borne by a carrier, preferably a printed circuit board. Each strip 12B bears the light sources forming one of the columns of the array 12.

The light sources 14 are closer to the vertically adjacent light sources than to the transversely adjacent light sources. For example, two vertically adjacent light sources are separated by a distance smaller than 10% of the vertical height of the emission surface of said light source, whereas two transversely adjacent light sources are separated by a distance larger than 10% of the transverse width of the emission surface of said light source.

The luminous module 10 also comprises at least one primary optical element 40.

The primary optical element 40 is an optical part, or a set of optical structures and/or parts, arranged to transfer the light emitted by said light sources 14 to a virtual projecting surface 60, which is located facing and at a predefined distance from the array 12, in the direction of emission of the light. FIG. 1 and FIG. 2 illustrates a light ray 16 emitted by a light source 14.

The virtual projecting surface 60 is preferably a virtual plane, but it may also be a virtual curved surface, for example in an embodiment in which the carrier and/or the printed circuit board 13 has a curved shape. As illustrated in FIG. 1, the primary optical element 40 is arranged in such a way that the projections in the horizontal plane 34 of the light beams 16 emitted by said light sources 14 form, on said virtual projecting surface 60, secondary light sources 62.

Advantageously, as illustrated in FIG. 1, the optical element 40 is arranged so that, in the horizontal plane 34, the dimension of the secondary light sources 62 is larger than a dimension 14*a* of the light sources 14 and so that the angular aperture $\beta$ of the secondary light beams 18 emitted by the secondary light sources 62 is smaller than an angular aperture $\alpha$ of the light beams 16 emitted by said light sources 14. The principle exploited here, in any horizontal plane, is that of the Lagrange invariant, which states that in any optical system $ny\alpha=n'y'\alpha'$, where n and n' are the refractive indices of the object and image spaces, respectively, y and y' are the object and image heights (or widths) respectively, and $\alpha$ and $\alpha'$ are the angles of the incident and emergent rays of an optical system. FIGS. 1 and 2 illustrate the propagation of a light ray 16, 18, 20 making different angles to the optical axis O.

The transverse dimension 62*a* of the cross section of the secondary sources 62 is more particularly defined so that the secondary light sources 62 adjoin or overlap transversely.

In one nonlimiting example embodiment, the transverse dimension 62*a* of the cross section of the secondary sources 62 may be at least 2 times larger than the transverse dimension 14*a* of the light sources 14.

Of course, the primary optical element 40 may be arranged to generate, in a horizontal plane, various enlargements M for various light sources 14 of the array. For example, the enlargement M of a light source 14 present on the optical axis O may be smaller than the enlargement of a light source 14 that is located at a transverse end of the array 12. This variant may be employed in the case where the vertical rows 12B of the light sources 14 are not positioned regularly in the transverse direction.

Furthermore, the primary optical element 40 is produced so as to have no enlarging effect, or a negligible enlarging effect, in the vertical direction, as illustrated in FIG. 2. This means that the primary optical element does not modify at its exit in a vertical direction V the angle of the incident rays. At the very most, the optical element may have the effect of moving, in the direction of the optical axis O, the conical light beam emitted by the light sources 14, this effect being similar to the effect obtained by inserting a planar optical plate into an optical beam that passes therethrough. It is well known that this movement depends on the thickness of the optical plate and on its refractive index, this also being the case for the primary optical element 40.

Of course, the primary optical element 40 may be a single optical part but it may comprise at least two optical parts that may have different shapes and/or refractive indices. Said at least two parts may also be manufactured from different materials and may comprise coatings, such as an antireflection coating, in order to improve the effectiveness with which the light is transmitted. In order to optimize the effectiveness and quality of the beam projected by the luminous module 10, the primary element 40 may comprise diffractive or refractive structures, such as diffraction gratings or Fresnel structures.

Figure 10:
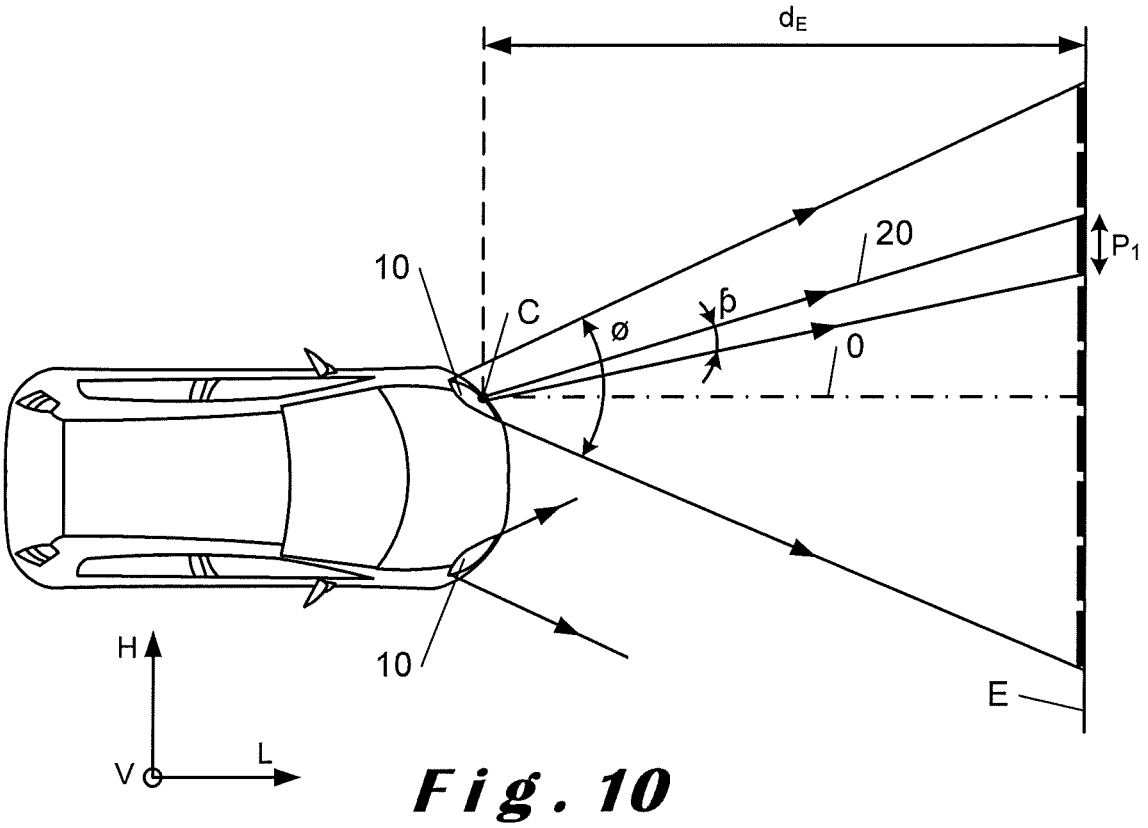
FIG. 10 is a top view of a vehicle and of a projection screen located in front of the vehicle.
Figure 11:
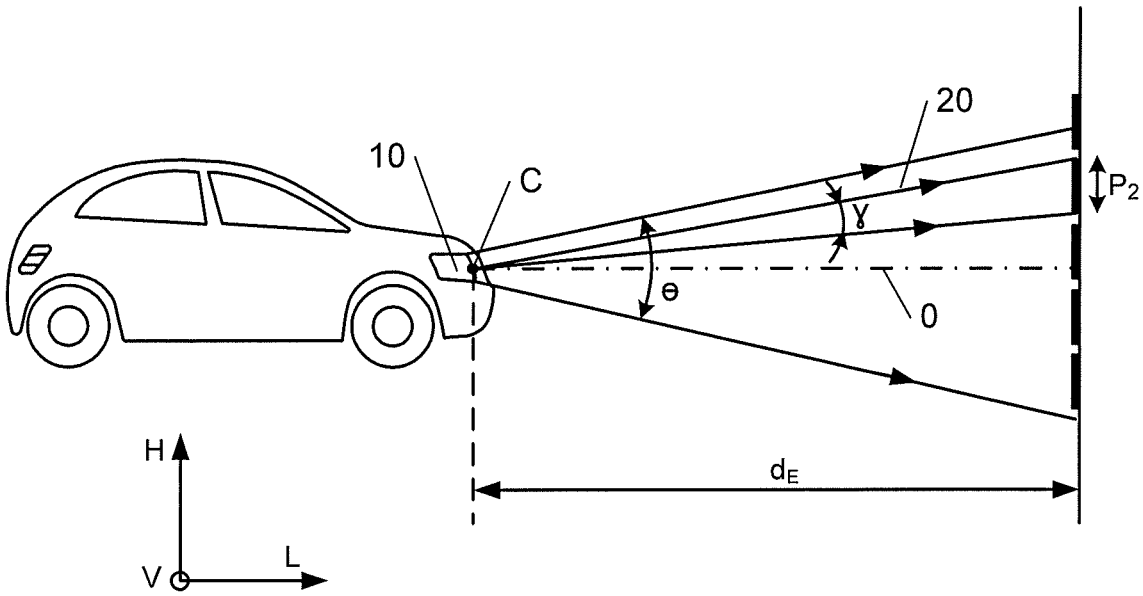
FIG. 11 is a side view of a vehicle and of a projection screen located in front of the vehicle.

The luminous module 10 comprises at least one bifocal imaging device 30 that is designed to project a light beam of each light source 14. The bifocal imaging device 30 preferably projects an image of each light source 14 to infinity, which image is usually measured on a virtual reference plane, which plane is placed at a distance $d_E$ with respect to the centre of the bifocal imaging device 30. In the automotive field, this distance is typically 25 m, as illustrated in FIGS. 10 and 11.

The bifocal imaging device 30 may be an optical system having a rotational symmetry about its optical axis O, but may also be an optical system that has a horizontal dimension larger than its vertical dimension.

In one preferred embodiment, the largest diameter of the bifocal imaging device 30 is smaller than 80 mm. The imaging device 30 has a first focal length F1 and a first transverse focusing surface 30*a* that is arranged substantially in coincidence with the virtual projecting surface 60. In one preferred embodiment, the first focusing surface 30*a* is a planar virtual surface as illustrated in FIGS. 1 to 5. Thus, by projecting the transversely adjoining secondary light sources 62, transversely adjoining luminous segments are obtained.

The imaging device 30 also has a second focal length F2 and a transverse focusing surface 30*b* that is arranged substantially in coincidence with the array 12 of the light sources 14. Of course, the focal length F2 is adapted to take into account the effect of the deviation in the vertical plane, of the primary optical element 40 as described above. Thus, by projecting the primary light sources, which are extremely close vertically, luminous segments that substantially adjoin vertically are obtained.

Thus, the total area illuminated by the luminous module 10 has a dimension of about n times $p_1$ in the horizontal direction and a dimension m times $p_2$ in the vertical direction and the vertical angular resolution is thus $p_2/d_E$ rad and the horizontal resolution $p_1/d_E$.

Advantageously, the luminous module 10 of the invention may be configured, in all the embodiments thereof, to obtain a horizontal angular resolution φ of better than 1° and preferably of better than 0.6°, and a vertical angular resolution γ of better than 0.6° and preferably better than 0.35°. Thus, for example, with:

a horizontal angular resolution φ of 0.6°; and
a vertical angular resolution γ of 0.35°; and
a number n of 15; and
a number m of 25;

an illuminated area of 5.2 m×7.9 m is produced on a screen E positioned at 25 m from the centre C. In this example, at 25 m from the luminous module 10, the height of each luminous segment is about 26 cm on the screen E.

As illustrated in FIGS. 10 and 11, the luminous module produces a beam having a horizontal angular aperture φ and a vertical angular aperture Θ. The horizontal angular aperture φ may be larger than 10°, and preferably larger than 20°. The vertical aperture Θ may be larger than 2°, and preferably larger than 4°. The various elements of the luminous module 10 may be adapted depending on the desired total horizontal and vertical angle and on the horizontal and vertical angular resolution. A person skilled in the art will be able to add, to the luminous modules 10, optical elements for correcting, depending on the nature of the light sources 14, their geometry and the spatial distribution of the light beams emitted by these sources 14, and depending on the type of imaging device 30, and depending on the type of primary element 40 according to the invention, a plurality of embodiments of which are described in the present document.

In one embodiment, the imaging device 30 possesses a circular symmetry, about the optical axis O, and a diameter defined in a vertical plane is smaller than 100 mm, and preferably smaller than 80 mm. In one variant, the vertical dimension of the device is different from its horizontal dimension. In this case, the largest diameter defined orthogonally to the optical axis is smaller than 100 mm, and preferably smaller than 80 mm.

Figure 8:
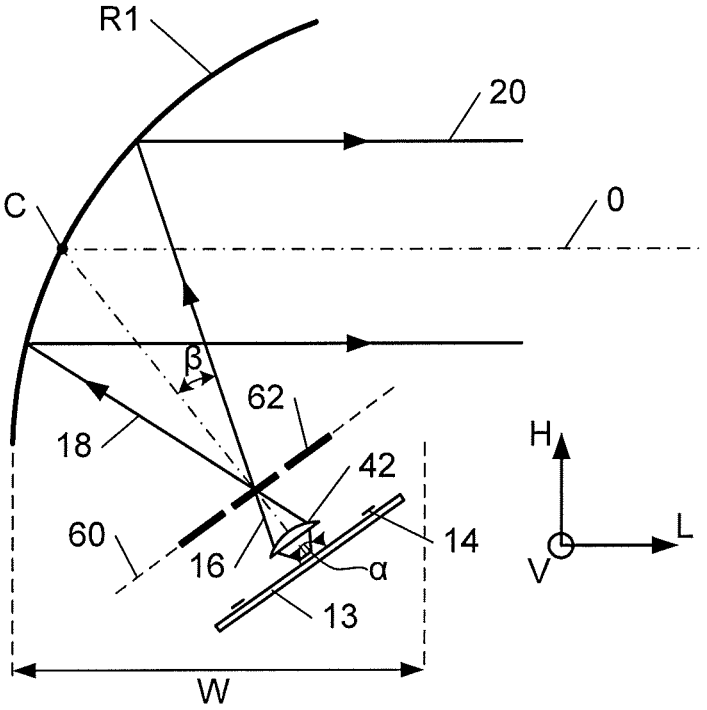
FIG. 8 is a top view of a luminous module comprising a reflective projecting device.
Figure 9:
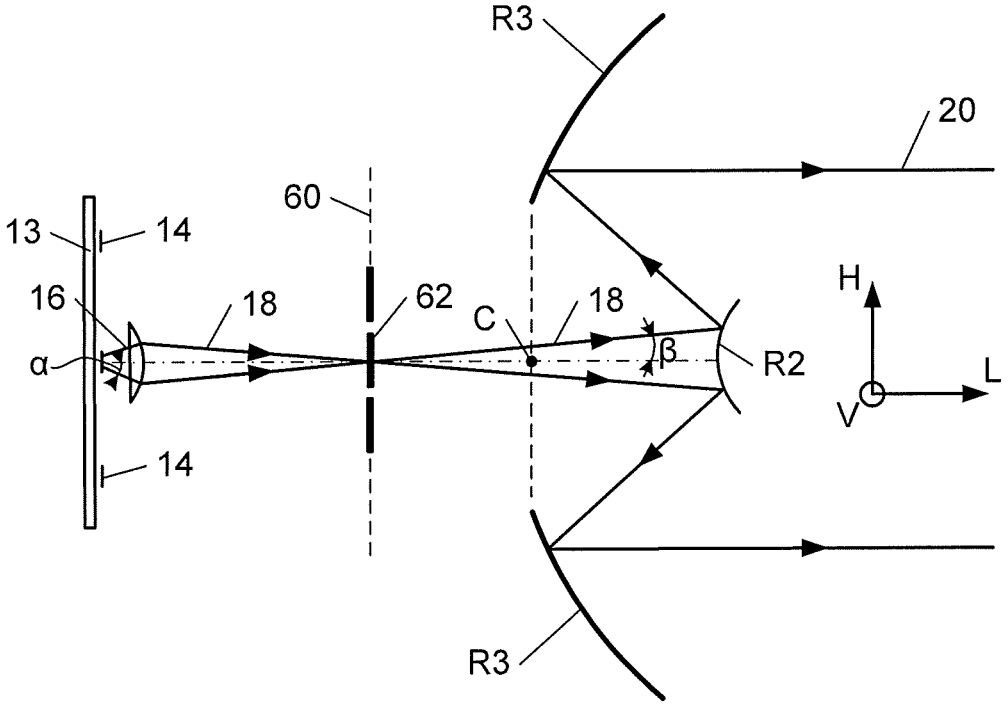
FIG. 9 is a top view of a luminous module comprising a projecting device having a Cassegrain configuration.

As illustrated in FIGS. 8 and 9, and described in detail for a few examples below, the imaging device may comprise reflective elements or be of catadioptric type.

Figure 3:
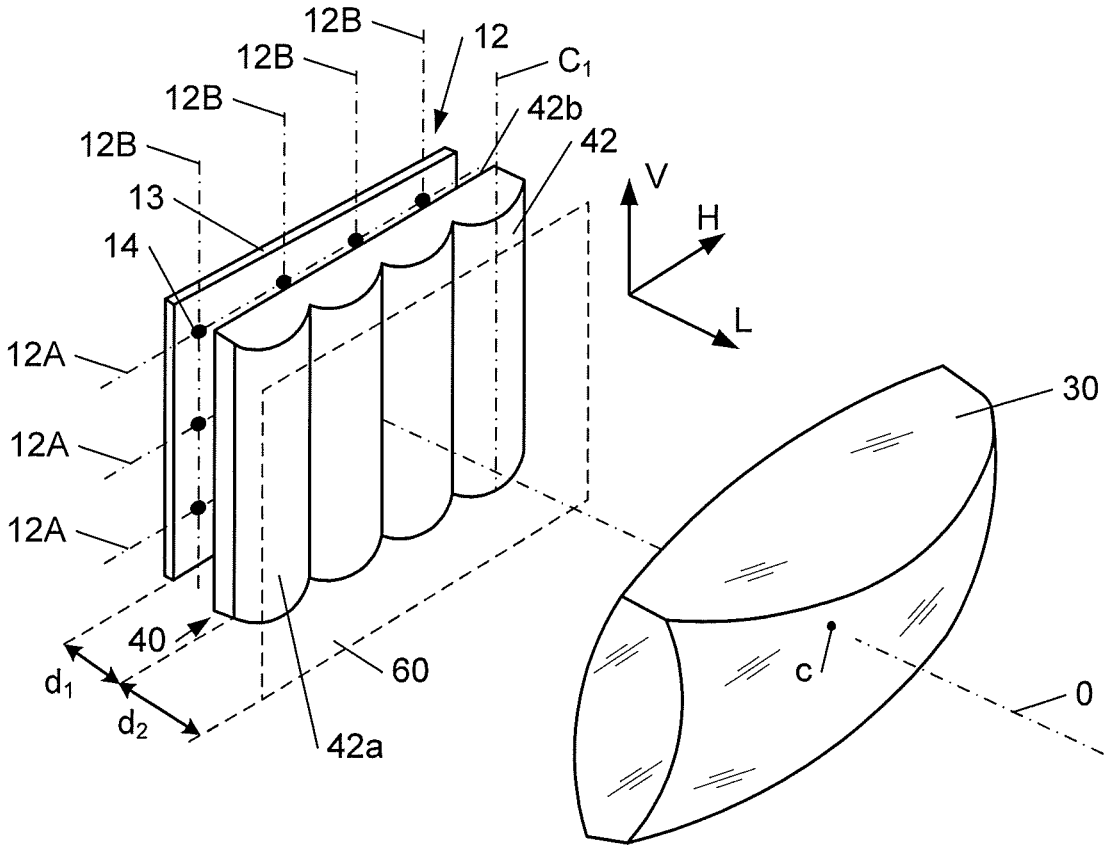
FIG. 3 is a perspective view that shows a primary optical element comprising an array of cylindrical lenses and a secondary optical element of a first luminous module, said elements being produced according to a first embodiment of the invention.

In one embodiment, which is shown in FIG. 3, the primary optical element 40 comprises an array of cylindrical lenses 42 each cylindrical lens 42 of which has a vertical axis C1 parallel to one of the vertical rows 12B of light sources 14. The array 40 of cylindrical lenses 42 comprises a light entrance surface 42*b* and a light exit surface 42*a* and forms an image, on the virtual projecting surface 60. Preferably, each light ray emitted by a light source 14 is transferred by the array of cylindrical lenses 42 to the virtual projecting surface 60.

The luminous distribution of this image consists of a horizontal row of vertically stretched luminous strips.

The cylindrical lenses 12 are arranged in order to form an enlarged image of the horizontal component 14*a* of the light sources 14 in the virtual projecting plane 60. The enlargement factor M, in a horizontal plane, obtained by the cylindrical lenses 12 is given by M=d2/d1 where d1 is the distance between a light source and the light entrance surface 42*b* and d2 is the distance between the light exit surface 42*a* and the virtual projecting surface 60, as illustrated in FIG. 3. In one example embodiment, the enlargement factor M is higher than 1.5, preferably higher than 2 or even more preferably higher than 5.

Preferably, said light entrance surface 42*b* is a transverse vertical planar surface. In one variant, the entrance surface 40*a* may also comprise a second array 40 of cylindrical lenses 42, which need not necessarily be symmetric with the array 40 of cylindrical lenses 42 of the exit surface 42*a*. In one variant, the array of cylindrical lenses may consist of two optical elements, each comprising a structure allowing light to be focused in a horizontal plane and having no focusing effect in a vertical plane, except the effect of deviating the incident beams, which focusing effect is due, as already explained, to the thickness and refractive index of the array of cylindrical lenses.

In one embodiment, the exit surfaces 42*a* of the cylindrical lenses 42 have, in any horizontal plane 34, a cross section of circular shape. In one variant, this shape is defined by a polynomial.

In one variant, diffractive structures may be arranged on the entrance surfaces 42*b* and/or the exit surfaces 42*a* of the cylindrical lenses.

A person skilled in the art will be able to produce these arrays of lenses using known manufacturing methods, such as moulding of plastic, replication or even the polymerization of polymers on an optical surface such as a glass surface.

In one variant, additional optical elements may be arranged between the array 12 of the light sources 14 and the array 40 of cylindrical lenses 42. These additional optical elements may for example comprise an array of microlenses, which may be useful in the case of certain types of light-emitting diodes 14 that do not comprise any integrated collimating lens.

In one embodiment, the array of cylindrical lenses is designed such that said secondary light sources 62 adjoin, as illustrated in FIG. 1.

In one variant embodiment, the array of cylindrical lenses 42 is designed so that said secondary sources 62 partially overlap in the horizontal direction H.

In one example embodiment, the overlap, in the horizontal direction H, of the secondary sources is smaller than 20% of the width of their horizontal component 62*a*.

Of course, the optical elements of the luminous module may be optimized and arranged so that the distribution of the intensity of the image produced in the far field, for example at 25 m from the luminous module 10, is a uniform distribution, even if the secondary sources overlap partially on the virtual projecting surface 60.

In another embodiment, illustrated in FIGS. 4, 5, 6 and 7, the primary optical element 40 comprises an array 50 of light guides 52, said array being placed between the array 12, 12A, 12B of light sources 14 and the imaging device 30.

Figure 4:
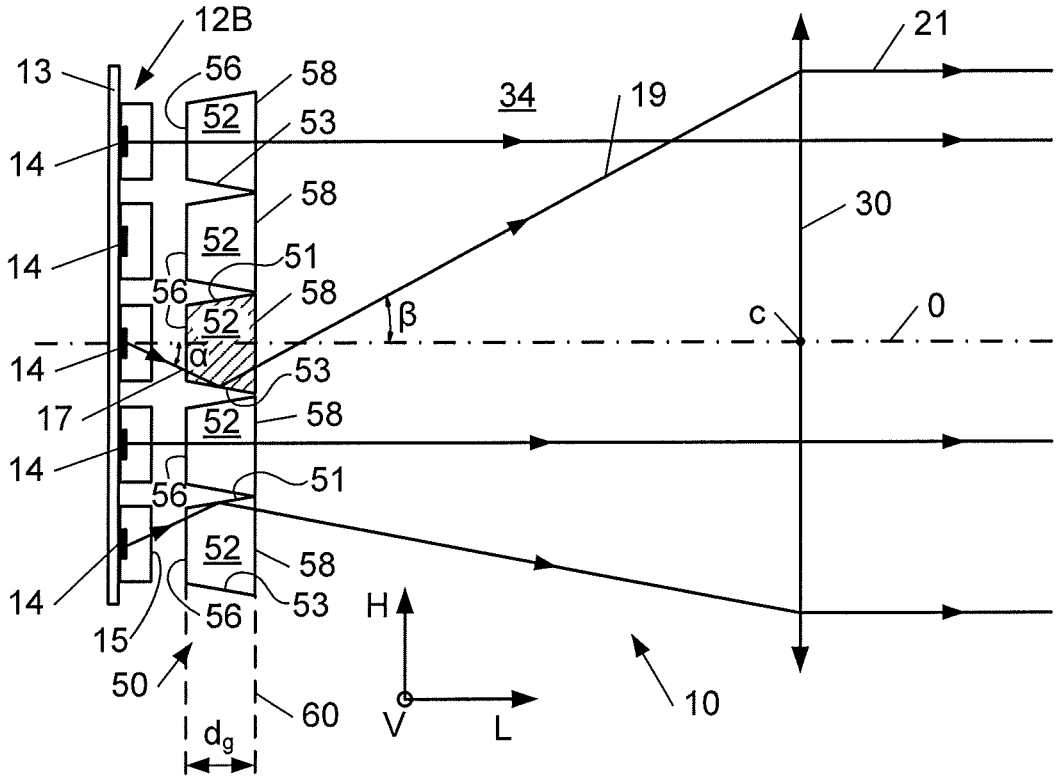
FIG. 4 is a top view that shows a primary optical element comprising light guides and a secondary optical element of a luminous module, said elements being produced according to a second embodiment of the invention.
Figure 5:
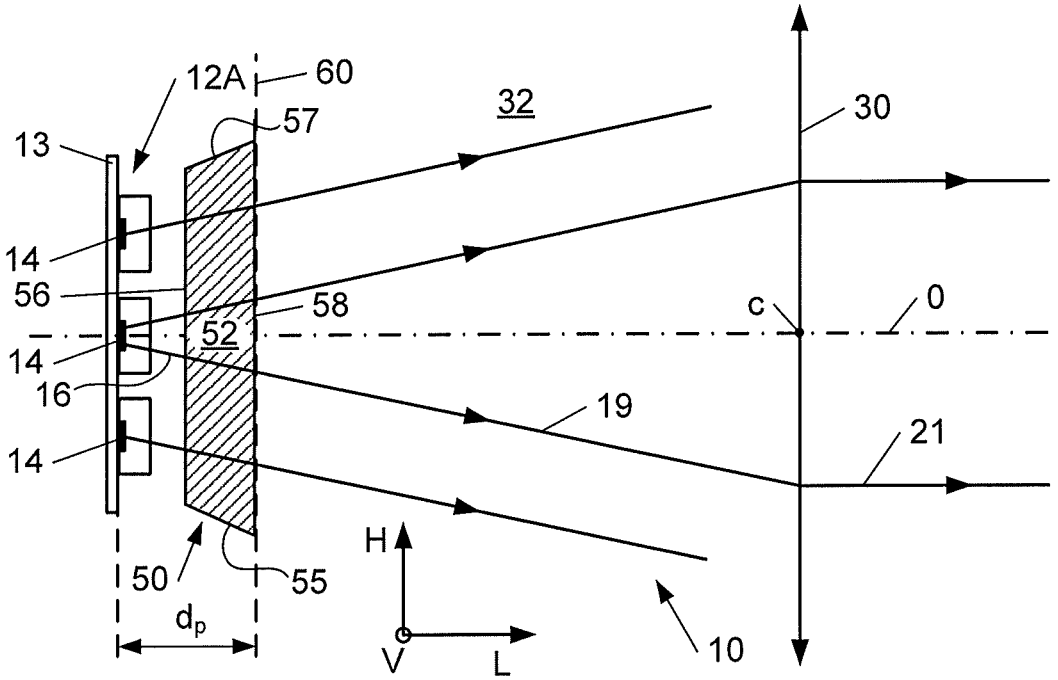
FIG. 5 is a side view that shows a primary optical element comprising light guides and a secondary optical element of a luminous module, said elements being produced according to the second embodiment of the invention.

Said light guides 52 have a first surface 56 on the side of the array 12 of light sources 14 and a second surface 58, which is also defined as the light exit surface, opposite to the first surface 56, which is also defined as the light entrance surface. The first surface 56 and the second surface 58 are connected by vertical walls 51, 53 that are configured to modify, in a plane containing the horizontal axis and relative to the optical axis O, the angle of propagation of a light ray incident on these surfaces 51, 53. FIGS. 4 and 5 show the propagation of a ray 16, 19, 21 emitted by a light source 14, transmitted by a light guide 52 and projected by a bifocal imaging device 30, respectively.

In one preferred embodiment, said first surface 56 is in immediate proximity to, or coincident with, the light exit surface 15 of a light source 14 of a vertical row 12B.

Figure 6:
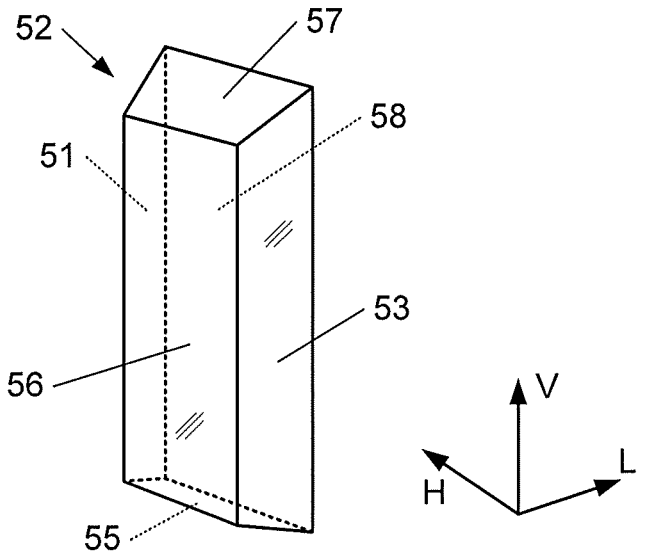
FIG. 6 is a perspective view of a light guide having planar side or vertical walls.
Figure 7:
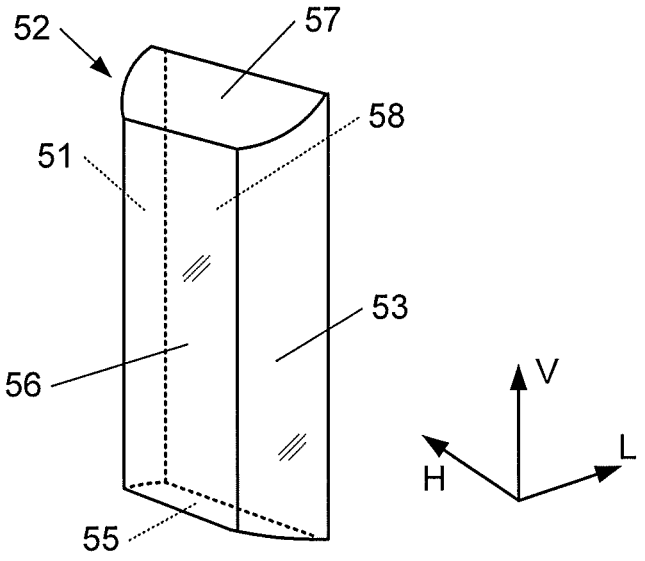
FIG. 7 is a perspective view of another light guide having curved side or vertical walls.

The light guide 52 also comprises an upper wall 57 and a lower wall 55 that are arranged in such a way that no light ray emitted by one of the vertical rows 12B of light sources is incident on these surfaces, as illustrated in FIG. 5. The upper and lower surfaces 57, 55 may be of planar or curved shape, as illustrated in FIGS. 6 and 7. In one embodiment, the upper and lower surfaces 57, 55 have no optical function and may therefore comprise at least one structure or structuring that make(s) assembly of this light guide into the luminous module 10 easy and therefore inexpensive. A person skilled in the art will be able to produce these structures directly in a mould of a light guide 52, made for example of injection-moulded plastic.

In one embodiment, the light guides 52 are made from a transparent solid material such as a plastic or a glass. In any cross section along the horizontal axis, the width of the first surface 56 is smaller than the width of the second surface 58. As illustrated in FIG. 4, at least one portion of the light emitted by a light source 14 is refracted by the first surface 56 and undergoes at least one total reflection from one of the sidewalls 51, 53. These sidewalls 51, 53 may be planar or may be curved. The shape of the horizontal projection of the sidewalls 51, 53 may be defined by a polynomial, and may for example be a parabolic shape or the shape of a segment of an ellipse or a hyperbolic shape. FIG. 6 shows a perspective view of a light guide 52 that comprises planar sidewalls 51, 53. Figure shows a perspective view of a light guide 52 that comprises curved sidewalls 51, 53. In any case, the sidewalls 51, 53 are configured in order to decrease the angle β of propagation, relative to the optical axis O, of a light ray emitted by a light source 14. As is shown in FIGS. 4 and 5, the light guide 52 is positioned in such a way that the exit surface 58 is in proximity to the virtual projecting surface 60. In one variant, the exit surface 58 coincides with the virtual projecting surface 60.

Similarly to the embodiment of FIG. 3 comprising an array of cylindrical lenses 42, the light guides 52 make it possible to produce secondary sources 60 that have a horizontal dimension larger than the horizontal width 14*a* of the light sources 14, and the angle β of propagation of the transmitted light rays of which, relative to the optical axis O, is smaller than the angle of emission of these light rays by the source 14 of emission a of these light rays.

In one variant (not shown) of the invention, the light guides 52 are hollow and comprise a wall at least one segment of the internal vertical surfaces 51, 53 of which is reflective. In this case, the surfaces 56 and 58 are a light entrance aperture 56 and a light exit aperture 58, respectively. The enlarging optical effect obtained is similar to that of the light guides 52 made from a transparent material described above. Specifically, the secondary emitting source 62 obtained on the virtual projecting surface 60, by transfer of the light from a source 14 via the light guide 52, has a larger horizontal dimension than that of the light source 14. The advantage of a light guide 52 produced with walls 51, 53 the internal surfaces of which are reflective is that more effective transmission of light is obtained since, in particular, there is no loss of light by refraction by the entrance aperture. In contrast, reflective light guides are often more expensive to manufacture because they in particular require a reflective coating.

In one variant, illustrated in FIG. 6, the light guides 52 have a trapezoidal shape in any horizontal plane 34 and have a rectangular shape for any cross section defined in a vertical plane parallel to said array 12.

In one example embodiment, the width of the second surface 58, for any cross section parallel to the horizontal plane 34, is equal to or larger than twice the width of the first surface 56 in size.

In another example embodiment, an axial dimension $d_g$ of the light guides 52, which dimension is defined along the optical axis O of the luminous module 10, is substantially identical to the dimension of the intersection of the first surface 56 with the horizontal plane 34.

In yet another example embodiment, an axial dimension $d_g$ of the light guides 52, which dimension is defined along the optical axis O of the luminous module 10, is at least 50% larger than the dimension of the intersection of the first surface 56 with the horizontal plane 34.

As is shown in FIGS. 8 and 9, the imaging device 30 may comprise reflective elements R1, R2 and R3. This allows luminous modules 10 that are shorter in the longitudinal direction L to be produced.

In one embodiment, a top view of which is shown in FIG. 8, the imaging device 30 comprises at least one mirror R1 placed in a so-called off-axis configuration. This configuration allows a luminous module of a length w, defined in the longitudinal direction, shorter than the variants illustrated in FIGS. 1, 2, 3, 4 and 5 to be produced.

In another variant, a top view of which is shown in FIG. 9, the imaging device 30 has a Cassegrain configuration, comprising two mirrors R2, R3 also allowing luminous modules 10 that are more compact in the longitudinal direction to be produced.

In other variants (not shown) of the invention, catadioptric configurations may be employed for the imaging device 30.

The invention claimed is:

1. The luminous motor-vehicle module, comprising:

at least one array of light sources, comprising m transverse rows and n vertical rows, a number n being higher than a number m;

at least one bifocal imaging device designed to project a light beam, the at least one bifocal imaging device having a horizontal first focusing surface and a vertical second focusing surface parallel to the first focusing surface;

at least one primary optical element, which at its exit does not modify in a vertical direction V an angle of incident rays, the primary optical element being arranged to transfer light emitted by the light sources to a virtual projecting surface that is defined between the at least one array of the light sources and the at least one bifocal imaging device, and that is coincident with the first focusing surface, in such a way that the projections in a plane containing a horizontal axis of the light beams emitted by the light sources form, on the virtual projecting surface, secondary light sources, wherein the vertical second focusing surface is coincident with a surface of the at least one array of the light sources, wherein, in a horizontal plane, a transverse dimension of the secondary light sources is larger than a transverse dimension of the light sources and an angular aperture of secondary light beams emitted by the secondary light sources is smaller than an angular aperture of the light beams emitted by the light sources.

2. The luminous module according to claim 1, wherein the primary optical element is an array of cylindrical lenses, and a longitudinal axis of each cylindrical lens is parallel to one of the vertical rows of light sources.

3. The luminous module according to claim 2, wherein the cylindrical lenses are designed to form, on the virtual projecting surface, secondary light sources, a horizontal component of which is an enlargement by a factor M of a horizontal component of the secondary light sources.

4. The luminous module according to claim 3, wherein the factor M is at least equal to 2.

5. The luminous module according to claim 2, wherein the cylindrical lenses are designed such that the secondary light sources adjoin one another.

6. The luminous module according to claim 2, wherein the cylindrical lenses are designed so that the secondary light sources partially overlap in a horizontal direction.

7. The luminous module according to claim 6, wherein the overlap of the secondary light sources in the horizontal direction is smaller than 20% of a width of their horizontal component.

8. The luminous module according to claim 1, wherein the primary optical element comprises an array of light guides, the array of light guides being placed between the array of light sources and the at least one bifocal imaging device.

9. The luminous module according to claim 8, wherein the array of light guides is made up of light guides having a first surface on a side of the array of light guides and a second surface opposite to the first surface having, in any plane containing the horizontal axis, a width larger than a width of the first surface.

10. The luminous module according to claim 9, wherein the light guides have a trapezoidal shape in any plane containing the horizontal axis and a rectangular shape in any cross section defined in a vertical plane parallel to the array of light guides.

11. The luminous module according to claim 10, the light guides comprise sidewalls having a curved shape in any plane containing the horizontal axis.

12. The luminous module according to claim 9, wherein the first surface is in immediate proximity to a light exit surface of a light source of the vertical row.

13. The luminous module according to claim 9, wherein, in any plane containing the horizontal axis, the width of the second surface has a dimension equal to or larger than twice a width of the first surface.

14. The luminous module according to claim 1, wherein the primary optical element comprises diffractive optical elements.

15. The luminous module according to claim 1, wherein n is at least equal to 10 and m is at least equal to 20.

16. The luminous module according to claim 3, wherein the cylindrical lenses are designed such that the secondary light sources adjoin one another.

17. The luminous module according to claim 3, wherein the cylindrical lenses are designed so that the secondary light sources partially overlap in the horizontal direction.

18. The luminous module according to claim 10, Wherein the first surface is in immediate proximity to a light exit surface of a light source of the vertical row.

19. The luminous module according to claim 10, wherein, in any plane containing the horizontal axis, the width of the second surface has a dimension equal to or larger than twice a width of the first surface.

20. The luminous module according to claim 2, wherein the primary optical element comprises diffractive optical elements.

* * * * *